US009095226B1

(12) United States Patent
Noorani

(10) Patent No.: US 9,095,226 B1
(45) Date of Patent: Aug. 4, 2015

(54) CRIB BUMPER ASSEMBLY

(71) Applicant: Behdad M. Noorani, Los Angeles, CA (US)

(72) Inventor: Behdad M. Noorani, Los Angeles, CA (US)

( * ) Notice: Subject to any disclaimer, the term of this patent is extended or adjusted under 35 U.S.C. 154(b) by 3 days.

(21) Appl. No.: 13/743,458

(22) Filed: Jan. 17, 2013

(51) Int. Cl.
*A47D 15/00* (2006.01)
*A61G 7/05* (2006.01)

(52) U.S. Cl.
CPC ..... *A47D 15/00* (2013.01); *A47D 15/008* (2013.01); *A47D 15/005* (2013.01); *A61G 7/0525* (2013.01); *A61G 2007/0522* (2013.01)

(58) Field of Classification Search
CPC ... A47D 15/00; A47D 15/008; A47D 15/005; A61G 2007/0522; A61G 2007/70525; A61G 7/05; A61G 7/0507
USPC ..... 5/424, 93.1, 425, 663, 946, 100
See application file for complete search history.

(56) References Cited

U.S. PATENT DOCUMENTS

| | | | | |
|---|---|---|---|---|
| 539,587 | A | 5/1895 | Mangum, Jr. | |
| 2,600,556 | A | 6/1952 | Malm | |
| 2,718,014 | A * | 9/1955 | Mizrach et al. | 5/945 |
| 3,018,492 | A * | 1/1962 | Rosen | 5/93.1 |
| 3,137,870 | A * | 6/1964 | Fink | 5/93.1 |
| 4,670,923 | A * | 6/1987 | Gabriel et al. | 5/424 |
| 4,767,419 | A | 8/1988 | Fattore | |
| 4,873,734 | A | 10/1989 | Pollard | |
| 5,421,046 | A * | 6/1995 | Vande Streek | 5/624 |
| 5,642,545 | A | 7/1997 | Howard | |
| 6,564,403 | B1 * | 5/2003 | Titus | 5/425 |
| 6,742,751 | B1 | 6/2004 | DeMoor | |
| 6,772,457 | B1 * | 8/2004 | Alaback | 5/93.1 |
| 7,716,760 | B1 * | 5/2010 | Alaback | 5/93.1 |
| 8,281,432 | B2 * | 10/2012 | Finell | 5/424 |
| 2008/0034499 | A1 | 2/2008 | Parish et al. | |
| 2010/0037393 | A1 * | 2/2010 | Finell | 5/424 |
| 2011/0041253 | A1 | 2/2011 | Fiebrich et al. | |

* cited by examiner

*Primary Examiner* — Peter M Cuomo
*Assistant Examiner* — Brittany Wilson

(57) ABSTRACT

A crib bumper assembly protects an infant from injury by bars spaced on the side of a crib. The assembly includes an elongated member having a first side and a second side. A plurality of flexible panels is coupled to the first side of the elongated member. Each flexible panel has a perimeter edge coupled to the elongated member wherein each flexible panel forms a chamber extending from the first side of the elongated member. A plurality of attachment members is coupled in spaced arrangement to the second side of the elongated member. Thus, the elongated member is configured for being coupled to spaced bars in a side of a crib.

7 Claims, 4 Drawing Sheets

CRIB BUMPER ASSEMBLY

BACKGROUND OF THE DISCLOSURE

Field of the Disclosure

The disclosure relates to crib bumper devices and more particularly pertains to a new crib bumper device for protecting an infant from injury by bars spaced on the side of a crib.

SUMMARY OF THE DISCLOSURE

An embodiment of the disclosure meets the needs presented above by generally comprising an elongated member having a first side and a second side. A plurality of flexible panels is coupled to the first side of the elongated member. Each flexible panel has a perimeter edge coupled to the elongated member wherein each flexible panel forms a chamber extending from the first side of the elongated member. A plurality of attachment members is coupled in spaced arrangement to the second side of the elongated member. Thus, the elongated member is configured for being coupled to spaced bars in a side of a crib.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
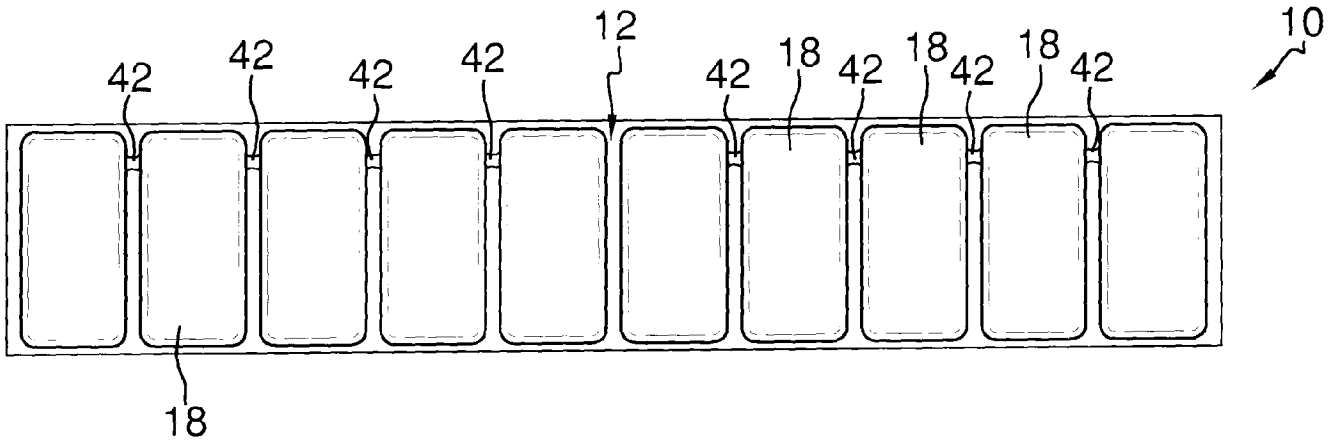
FIG. 1 is a front view of a crib bumper assembly according to an embodiment of the disclosure.
Figure 2:
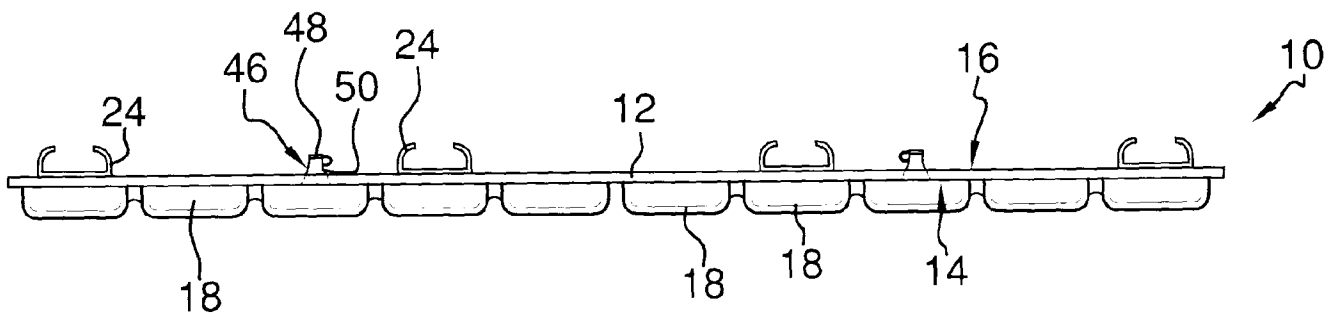
FIG. 2 is a top view of an embodiment of the disclosure.
Figure 3:
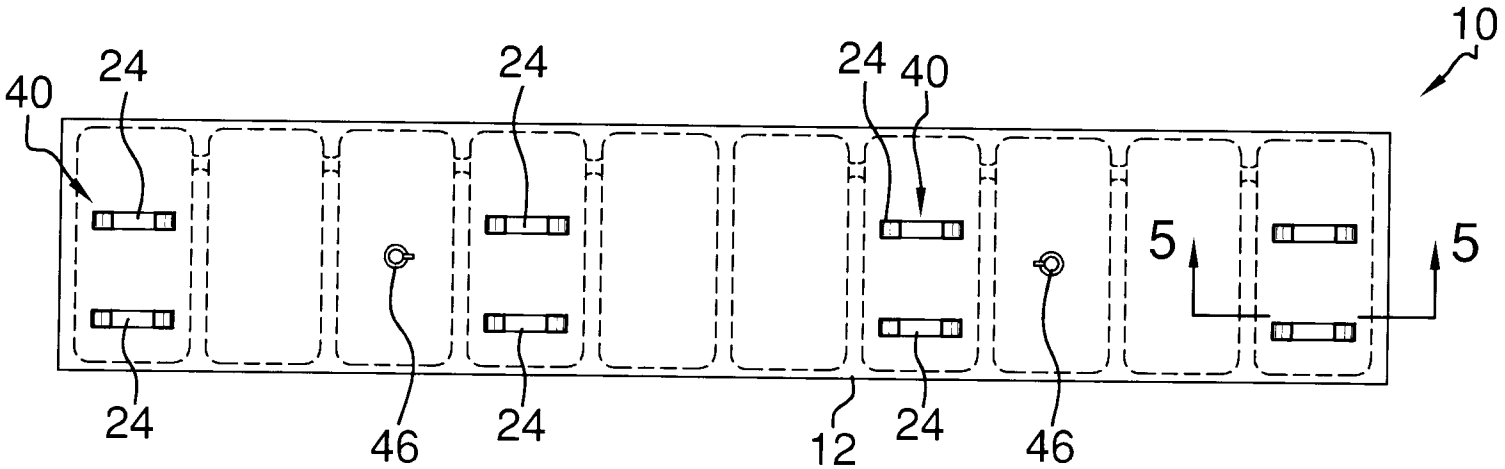
FIG. 3 is a back view of an embodiment of the disclosure.
Figure 4:
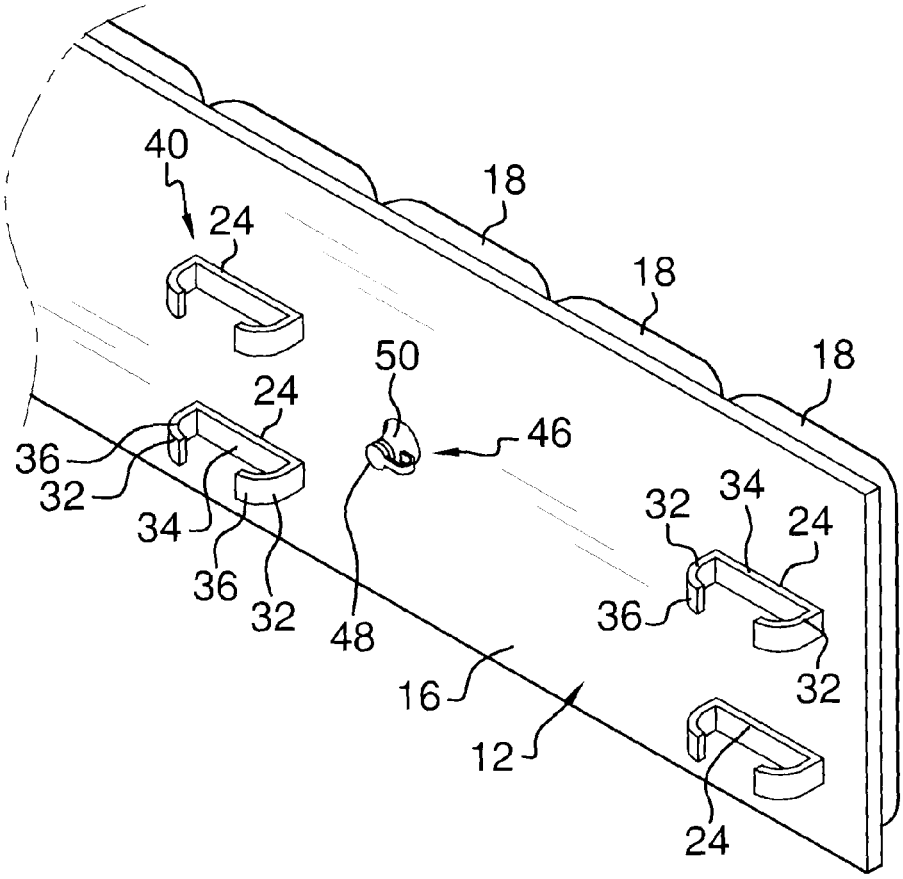
FIG. 4 is a top back side perspective view of an embodiment of the disclosure.
Figure 5:
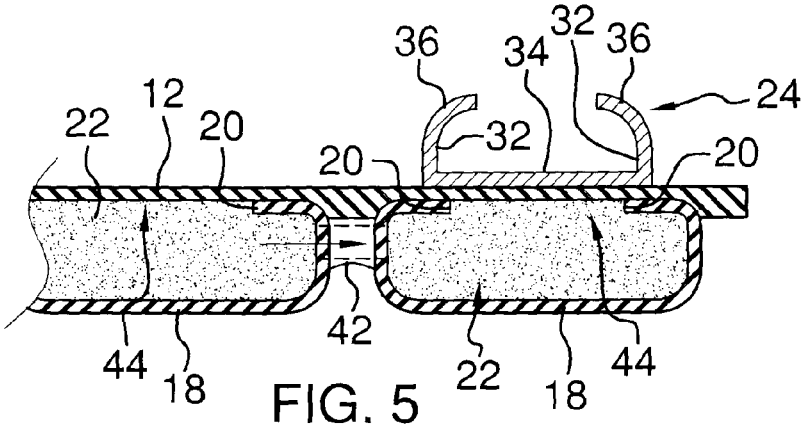
FIG. 5 is a cross-sectional view of an embodiment of the disclosure taken along line 5-5 of FIG. 3.
Figure 6:
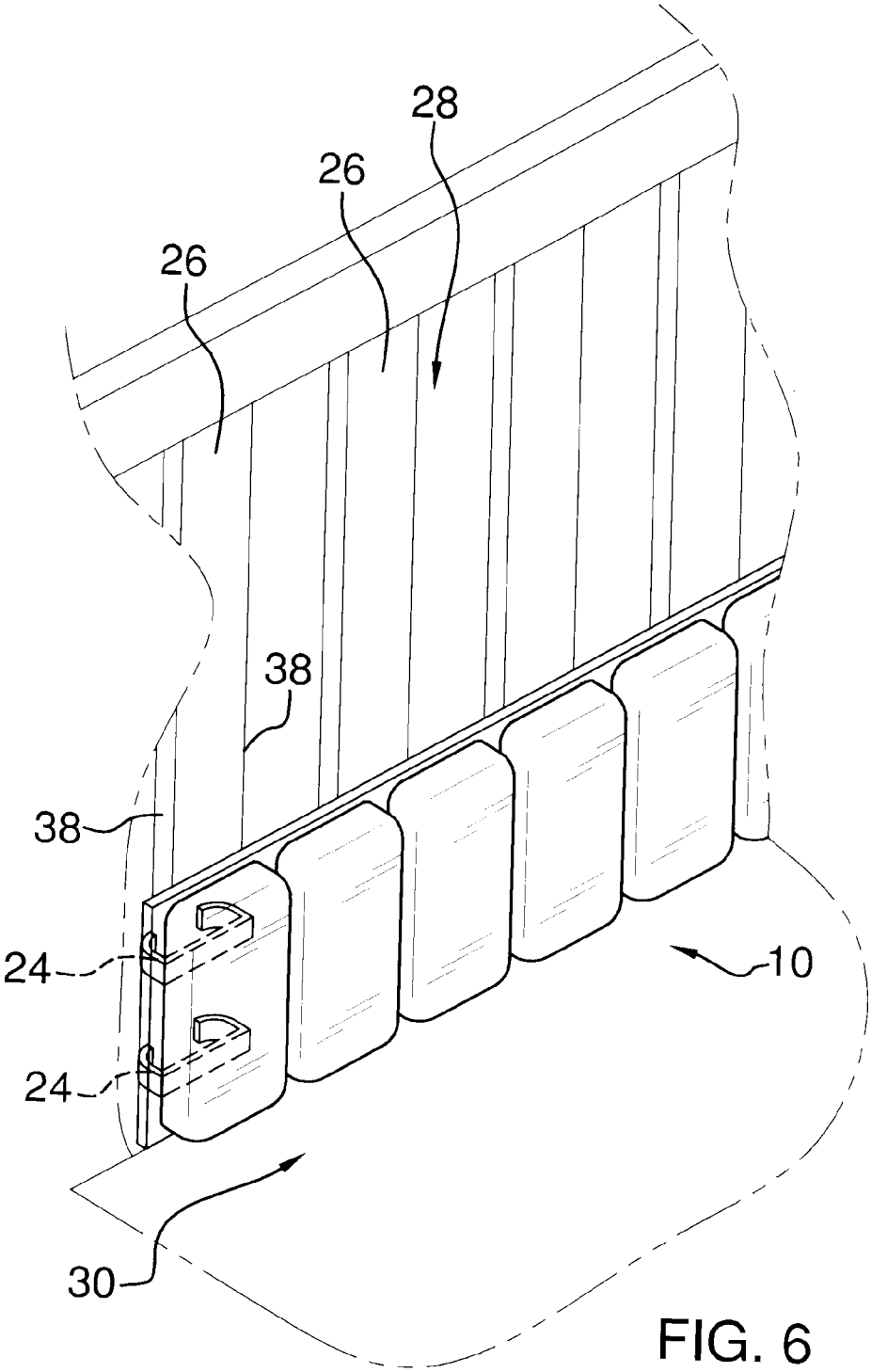
FIG. 6 is a top front side perspective view of an embodiment of the disclosure in use.

With reference now to the drawings, and in particular to FIGS. 1 through 6 thereof, a new crib bumper device embodying the principles and concepts of an embodiment of the disclosure and generally designated by the reference numeral 10 will be described.

As best illustrated in FIGS. 1 through 6, the crib bumper assembly 10 generally comprises an elongated member 12 having a first side 14 and a second side 16. A plurality of flexible panels 18 is coupled to the first side 14 of the elongated member 12. Each flexible panel 18 has a perimeter edge 20 coupled to the elongated member 12 wherein each flexible panel 18 forms a chamber 22 extending from the first side 14 of the elongated member 12. A plurality of attachment members 24 is coupled in spaced arrangement to the second side 16 of the elongated member 12 wherein the elongated member 12 is configured for being coupled to spaced bars 26 in a side panel 28 of a crib 30. Each attachment member 24 has a pair of arm sections 32 and a planar medial section 34 coupled to and extending between the arm sections 32. The medial section 34 is coupled to the second side 16 of the elongated member 12. Each of the arm sections 32 extends outwardly from the second side 16 of the elongated member 12. Each arm section 32 has a curved portion 36 extending away from the elongated member 12 and towards a middle of the medial section 34. Thus, each attachment member 24 is configured to extend around opposite sides 38 of the bar 26 of the side panel 28 of the crib 30. The plurality of attachment members 24 is arranged into spaced vertically aligned pairs 40 of the attachment members 24.

A plurality of conduits 42 are provided. Each conduit 42 is coupled to and extends between an associated pair of the flexible panels 18. Thus, each chamber 22 is in fluid communication with at least one adjacently positioned other chamber 22. Each flexible panel 18 is coupled to an associated one of the conduits 42 wherein each chamber 22 is fluidly coupled to each other chamber 22.

A plurality of depressions 44 is provided. Each depression 44 is positioned in the first side 14 of the elongated member 12. Each flexible panel 18 is aligned with and coupled to the elongated member 12 wherein each flexible panel 18 extends from an associated one of the depressions 44.

At least one nozzle 46 is coupled to the elongated member 12. The nozzle 46 extends through the elongated member 12 between the first side 14 and the second side 16. The nozzle 46 is aligned with one of the chambers 22 interconnected by the conduits 42 to permit filling all the interconnected chambers 22 with air. Each nozzle 46 includes a cap 48 attached to a flexible conical portion 50 to selectively close the nozzle 46 and seal off the chambers 22 retaining the air in the chambers 22.

In use, the chambers 22 are filled with air by roving the cap 48 and blowing into the nozzle 46. After inflating the chambers 22, the elongated member 12 is attached to the side panel 28 of the crib 30 by positioning bars 26 of the side panel 28 between the arm sections 32 of the attachment members 24. The assembly 10 is then coupled to the crib 30 to provide a cushion for the side panel 28 of the crib 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A crib bumper assembly comprising:

an elongated member having a first side and a second side, said first and second sides positioned opposite of each other;

a plurality of flexible panels coupled to said first side of said elongated member, each said flexible panel having a perimeter edge coupled to said elongated member wherein each said flexible panel forms a chamber extending from said first side of said elongated member;

a plurality of attachment members coupled in spaced arrangement to said second side of said elongated member wherein said elongated member is configured for being coupled to spaced bars in a side of a crib;

a nozzle coupled to said elongated member, said nozzle extending through said elongated member between said first side and said second side, said nozzle being aligned with one of said chambers; and a plurality of depressions positioned in said first side of said elongated member, each flexible panel being aligned with and coupled to said elongated member wherein each flexible panel extends from an associated one of said depressions.

2. The assembly of claim 1, further comprising a plurality of conduits, each conduit being coupled to and extending between an associated pair of said flexible panels wherein each said chamber is in fluid communication with at least one adjacently positioned said chamber.

3. The assembly of claim 2, further comprising each said flexible panel being coupled to an associated one of said conduits wherein each chamber is fluidly coupled to each other said chamber.

4. The assembly of claim 1, further comprising each said attachment member having a pair of arm sections and a planar medial section coupled to and extending between said arm sections, said medial section being coupled to said second side of said elongated member, each of said arm sections extending outwardly from said second side of said elongated member.

5. The assembly of claim 4, further comprising each said arm section having a curved portion extending away from said elongated member and towards a middle of said medial section wherein each said attachment member is configured to extend around opposite sides of the bar of the side of the crib.

6. The assembly of claim 1, further comprising said plurality of attachment members being arranged into spaced vertically aligned pairs of said attachment members.

7. A crib bumper assembly comprising:

an elongated member having a first side and a second side;

a plurality of flexible panels coupled to said first side of said elongated member, each said flexible panel having a perimeter edge coupled to said elongated member wherein each said flexible panel forms a chamber extending from said first side of said elongated member;

a plurality of attachment members coupled in spaced arrangement to said second side of said elongated member wherein said elongated member is configured for being coupled to spaced bars in a side of a crib, each said attachment member having a pair of arm sections and a planar medial section coupled to and extending between said arm sections, said medial section being coupled to said second side of said elongated member, each of said arm sections extending outwardly from said second side of said elongated member, each said arm section having a curved portion extending away from said elongated member and towards a middle of said medial section wherein each said attachment member is configured to extend around opposite sides of the bar of the side of the crib, said plurality of attachment members being arranged into spaced vertically aligned pairs of said attachment members;

a plurality of conduits, each conduit being coupled to and extending between an associated pair of said flexible panels wherein each said chamber is in fluid communication with at least one adjacently positioned said chamber, each said flexible panel being coupled to an associated one of said conduits wherein each chamber is fluidly coupled to each other said chamber;

a plurality of depressions positioned in said first side of said elongated member, each flexible panel being aligned with and coupled to said elongated member wherein each flexible panel extends from an associated one of said depressions; and a nozzle coupled to said elongated member, said nozzle extending through said elongated member between said first side and said second side, said nozzle being aligned with one of said chambers.

* * * * *